US005760319A

United States Patent [19]

Dickinson

[11] Patent Number: 5,760,319

[45] Date of Patent: Jun. 2, 1998

[54] HOLLOW ELONGATED SOUND INSTRUMENT WITH CAVITY-TO-WALL BRIDGING AND INTERVAL VIBRATION GENERATOR

[76] Inventor: Joseph W. Dickinson, 12 Congress St., Westfield, Mass. 01085

[21] Appl. No.: 721,723

[22] Filed: Sep. 27, 1996

Related U.S. Application Data

[63] Continuation of Ser. No. 387,093, Feb. 13, 1995, abandoned.

[51] Int. Cl.[6] ..... G10D 1/00

[52] U.S. Cl. ..... 84/173

[58] Field of Search ..... 84/723–734, 743, 84/253, DIG. 21, 7–15, 173–199

[56] References Cited

U.S. PATENT DOCUMENTS

| | | | |
|---|---|---|---|
| 2,187,611 | 1/1940 | Miessner | 84/731 |
| 2,200,718 | 5/1940 | Miessner | 84/733 |
| 2,219,539 | 10/1940 | Riechers | 84/733 |
| 4,338,848 | 7/1982 | Rhodes | 84/253 |
| 4,378,722 | 4/1983 | Isakson | 84/726 |
| 4,379,421 | 4/1983 | Nunan | 84/728 |
| 4,688,460 | 8/1987 | McCoy | 84/724 |
| 4,991,488 | 2/1991 | Fala et al. | 84/731 |
| 5,237,126 | 8/1993 | Curtis et al. | 84/724 |

*Primary Examiner*—Stanley J. Witkowski
*Attorney, Agent, or Firm*—Deborah A. Basile, Esquire

[57] ABSTRACT

The invention is a tone producing device consisting of a tone source inside of an elongated cavity attached to at least one point of the object surrounding the cavity (such as the walls of a tube). The tone source can be any tone producing device including: (1) a length or lengths of musical string held under tension within the cavity, (2) one or more tines suspended within the cavity, or (3) an electronic tone producing device. When vibrating, the tone source transmits sound waves in four different ways: (1) sound transmitted from tone source to cavity wall; (2) sound transmitted from tone source to external soundboard; (3) sound transmitted by combination of tone source and cavity wall to external soundboard; and (4) electronic amplification to a speaker.

4 Claims, 2 Drawing Sheets

HOLLOW ELONGATED SOUND INSTRUMENT WITH CAVITY-TO-WALL BRIDGING AND INTERVAL VIBRATION GENERATOR

This application is a Continuation of application Ser. No. 08-387,093 filed Feb. 13, 1995 abandoned.

I. BACKGROUND

1. Field of the Invention

The invention relates generally to devices which produce musical tones.

2. Information Disclosure Statement

Currently there are a limited number of devices which attempt to produce musical sound through the use of a vibrational tone source housed within an elongated hollow object. These devices include wind and brass instruments and toys. Each of these devices transmits and amplifies tone through the movement of air in the cavity of the device.

The general object of the invention is to provide means of transmitting musical vibrations of the tone source to the body surrounding an elongated cavity, to an external soundboard or to a speaker for sound amplification. A further object of the invention is to provide an inexpensive, simple device for creating vibrations both audible to the human ear and otherwise for use in a multitude of consumer products, calibrating or measuring devices, medical products or musical instruments.

II. BRIEF SUMMARY OF THE INVENTION

The invention is a tone producing device consisting of a tone source inside of an elongated cavity attached to at least one point of the object surrounding the cavity (such as the walls of a tube). The tone source can be any tone producing device including: (1) a length of musical string held under tension within the cavity, (2) a tine suspended within the cavity, or (3) an electronic tone producing device. In the case where the tone source is a length of musical string held under tension, the string may be tuned by moveable sleeves at each end of the cavity. When operated, the tone source is excited by some strike mechanism and vibrates freely at a tuned pitch until it is de-energized by some damper mechanism and returns to rest. The tone source is excited by either mechanical, electromechanical or magnetic means coming in contact or in close proximity with the source at some point along the length of the cavity.

When vibrating, the tone source transmits sound waves in four different ways: (1) sound transmitted from tone source to cavity wall; (2) sound transmitted from tone source to external soundboard; (3) sound transmitted by combination of tone source and cavity wall to external soundboard; and (4) electronic amplification to a speaker.

The invention can have many different strike mechanisms e.g., a mechanical pushbutton-type striker, an electromechanism, or an electromagnet which pulsates at a natural mode frequency of the tone source. The cavity wall may be constructed of any material, the cavity and cavity wall may be different dimensions, the width of the cavity and cavity wall may vary along their length and more than one cavity and cavity wall may be arranged in relation to each other within a device. If the tone source is a string, the string may be many different types, for instance, wound, gut or metal, different diameters and different lengths of string can be selected to change the tone or pitch or to customize a device for a particular purpose or to fit a particular price constraint. In string tone tubes multiple bridges may be provided to change the speaking length and pitch of the string.

There are many consumer applications for Tone Tubes including, complete musical instruments, door announcement systems (both mechanical and electromechanical) toys, walkway markers and "wind chime" style tone producers. Many accessories can accompany and accommodate different styles and spatial arrangements of the invention. Multiple devices may be interconnected or used together in interesting configurations for a spatially pleasing sound and/or appearance. The invention has applications in the health care industry and may be used as a tool to measure minute movement in architecture, or geophysics.

The invention relates as well to the use of a range of vibration which is beyond the range of human hearing. The invention vibrating in the ultrasonic range could be used for ultrasonic cleaning, water molecule dispersal and pest repellant devices. Microscopic counterparts of the invention containing a metallic or magnetic vibration source could be excited by application of an external alternating or pulsating magnetic field and thereby provide an extremely localized transmission of ultrasonic wave energy. This embodiment of the invention has medical, dental and veterinarian applications. Counterparts of the invention with musical string(s) may be used to measure slight movement in an architectural structure or to measure geophysical vibration or movement. In this regard, the counterparts of the invention may be monitored for unintentional changes in tone when they are installed on or as part of a structure or in connection with a geophysical testing site. They may therefore be used to measure or show indications of movement of the structure, as the tone changes. This type of device could be activated by application of an external pulsating magnetic field or by the interaction of an external magnetic field with another magnetic field created by current flow in the metal musical string.

III. BRIEF DESCRIPTION OF THE DRAWINGS

IV. DESCRIPTION OF THE PREFERRED EMBODIMENT(S)

Figure 1:
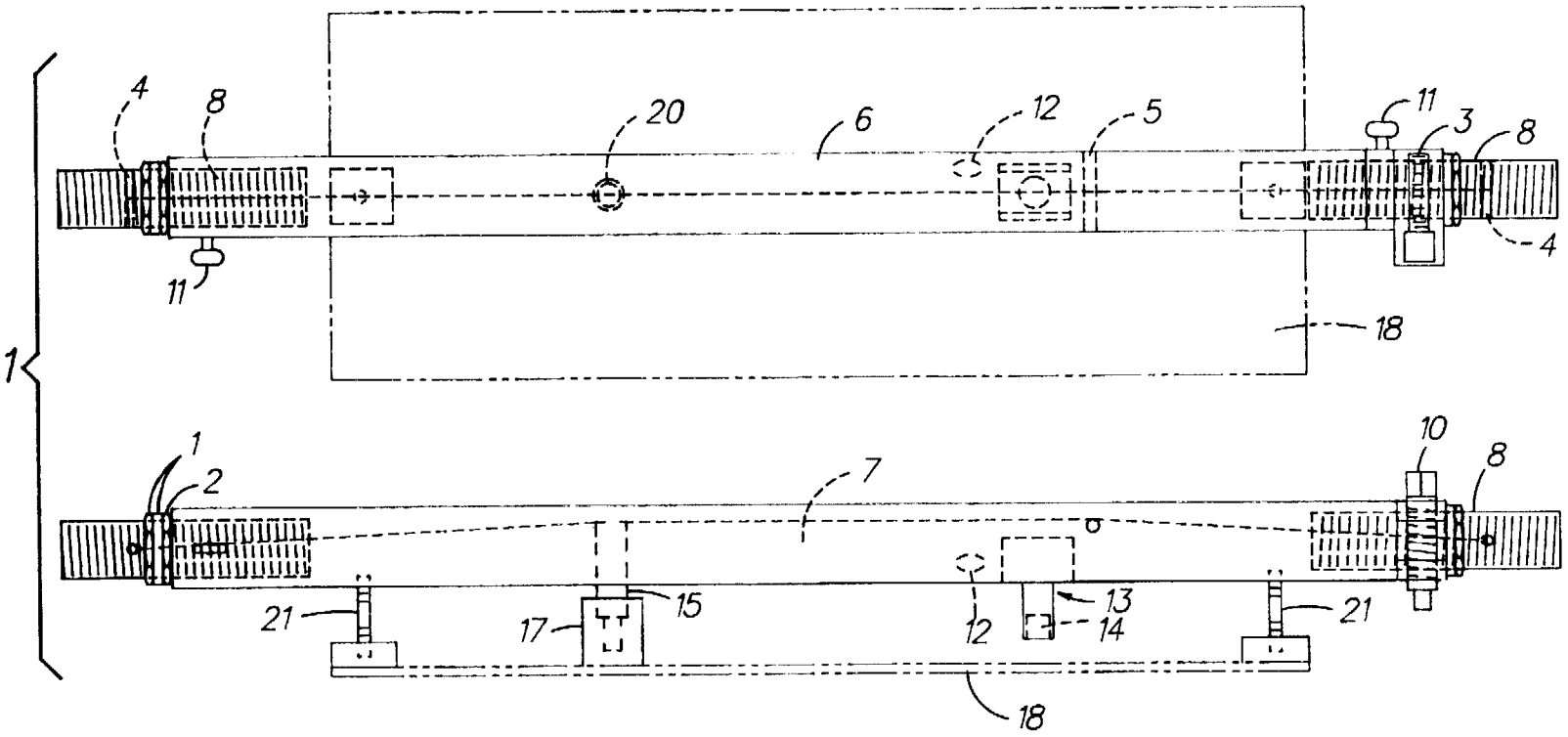
FIG. 1 is a front view and a side view of the invention showing its general shape.
Figure 2:
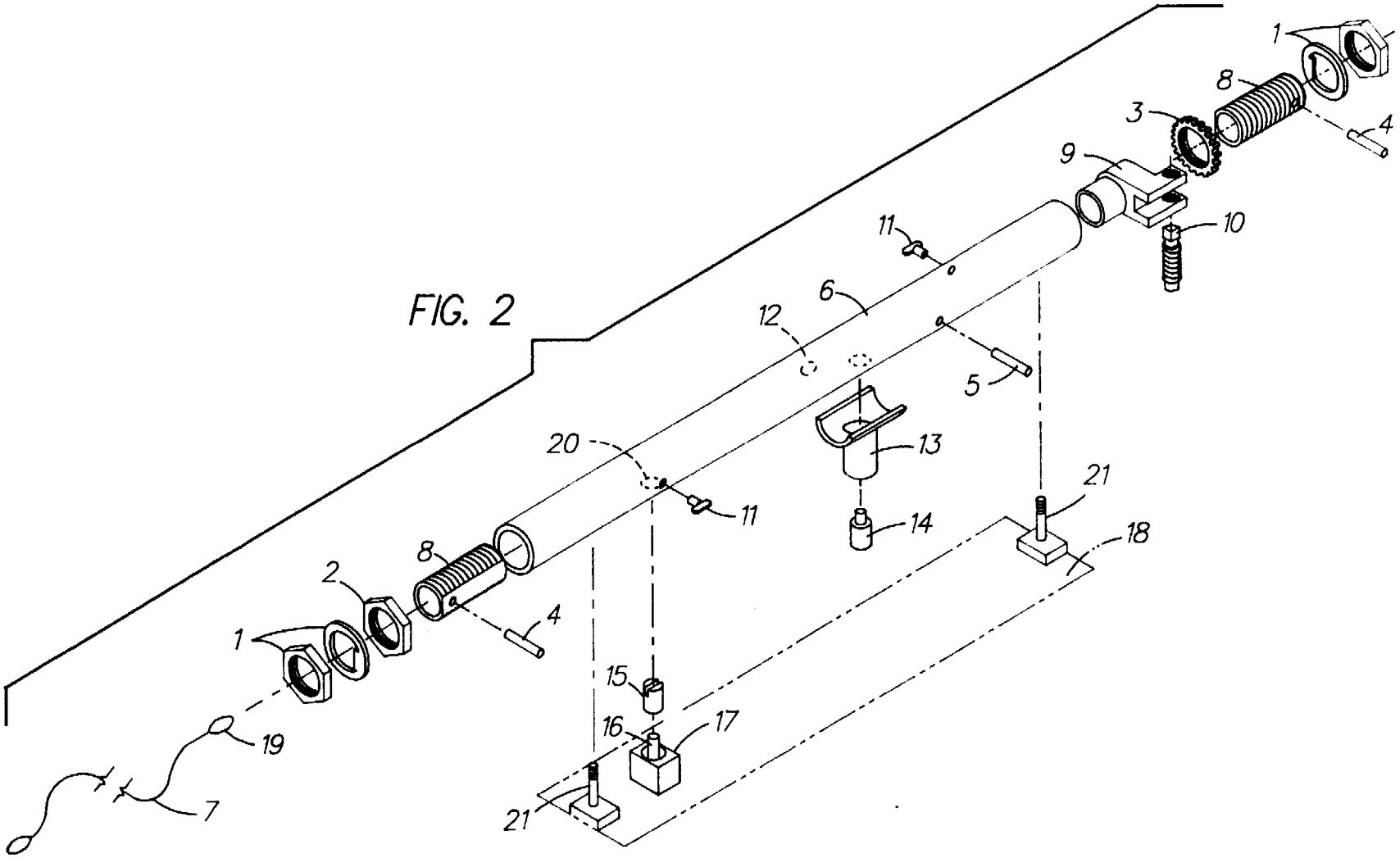
FIG. 2 is an isometric view of the mechanical components as assembled, of the invention.

Referring to FIGS. 1 and 2, an elongated cavity wall (6) with a bridge (17), an action flange (13) and an external soundboard (18) is shown. This embodiment of the invention uses a musical string as the tone source. When assembled, the tension in the string (7) is created with either or both the nut (1) or the nut and lockwasher (2) at the end of the cavity wall (6). The nut (1) or nut and lockwasher (2) and gear nut (3) secure the string (7) within the gear housing (9) when the string is adjusted as desired. The tension pin (4) holds the string (7) and the looped string end (19). The tension pin is flush with the threaded tube surface to allow free movement of the nut (1) and (2) over them. The bridge (17) engages the dowel (16) which is long enough to protrude into the cavity wall (6) at the bridge collar (15) which prevents the string (7) from moving sideways. The bridge (17) does not touch the walls of the cavity as it engages into the bridge entry hole (20). A strike mechanism or damper which would energize and de-energize the string (7) is the action (14) and is introduced to the cavity wall (6) through the action flange (13) and or through the port of entry (12).

A Tube Bridge Tension Pin (5) is located near the end of the cavity wall (6) furthest away from the soundboard (18) and the bridge (17). The Tube Bridge Tension Pin (5) serves as a second bridge to transfer motion from the string (7) to the cavity wall (6) and as the cavity moves, from the cavity wall (6) to the string (7). The Tube Bridge Tension Pin (5) assures that the speaking length (the portion of the string producing the most predominant sound) is held between two fixed points such that only the tension (and not the length) of the string (7) changes with the movement of the threaded sleeve (8). Therefore in one preferred embodiment of the invention, one bridge is from string to soundboard and one bridge is from string to cavity wall and a combination blend of sound is created in the air around the cavity wall. Some sound is created by the motion of the cavity wall and some is created by the motion of the soundboard. If the invention used only the Tube Bridge Tension Pin, all string movement would be transferred to the walls of the cavity, resulting in sound X. The use of a very rigid non-resonate cavity wall would eliminate sound created by the movement of the cavity wall and all string movement would be transferred to the soundboard resulting in sound Y. In one preferred embodiment, a combination, or sound ZY is created by the string movement transferred to the cavity wall and to the soundboard and by the motion of the cavity wall and the motion of the soundboard. The Tone Tube is secured to the rims of the external soundboard by connection means (20).

Tuning of the string is accomplished by a gear housing (9) which is inserted into the cavity wall (6) and consists of a worm gear having a shaft with a square turning arm (10) which engages a gear nut (3) which in turn engages the threaded sleeve (8). The threaded sleeve (8) has a flat side which makes contact with the set screws (11) which hold the threaded sleeve (8) and prevent it from twisting within the cavity but allow it to slide in and out of the cavity depending on the degree of tightening of the set screws (11).

In another preferred embodiment of the invention the string (7) is replaced by a tine or electronic tone producing means (21) or other tone producing source. The tuning and tension apparatus (1-11, 19) is eliminated and electronic means (21) is incorporated for the electronic tone producing source embodiment.

Having described the preferred embodiment of the invention with reference to the accompanying drawings, it is to be understood that the invention is not limited to that precise embodiment and that various changes and modifications may be effected therein by one skilled in the art without departing from the scope or spirit of the invention as defined in the appended claims.

What is claimed is:

1. A musical sound producing device having one or more musical strings of any length and any dimension held under tension lengthwise within a tubular elongated cavity, said cavity having a cavity wall which encloses said tubular elongated cavity;

said musical sound producing device having two means for holding said string or strings under tension, said string or strings having two ends, said holding means securing each of said two ends of said string or strings to said cavity wall;

said musical sound producing device having one or more bridge means extending from and connecting a point along and between said ends of said string or strings to a point or points on said cavity wall between said holding means; and, said cavity wall and said cavity fully extended between said holding means, said string or strings positioned to vibrate freely between said holding means.

2. The device of claim 1 having one or more bridge means extending from and connecting a point along and between said ends of said string or strings to a point or points outside said cavity wall on an external soundboard which amplifies the musical sound produced.

3. The device of claim 1 having tuning means for adjusting the tension of said musical string or strings.

4. The device of claim 1 wherein said cavity wall is flexible in response to external forces.

* * * * *